US005996490A

United States Patent [19]

Baureis et al.

[11] Patent Number: 5,996,490

[45] Date of Patent: Dec. 7, 1999

[54] POSITIONING DEVICE FOR A PRINTING PRESS

[76] Inventors: Martin Baureis, Königsberger Strasse 3, D-69168 Wiesloch; Michael Rehberg, Helmholtzstrasse 36, D-68723 Schwetzingen; Norbert Thünker, Schillerstrasse 6a, D-69493 Hirschberg; Lothar Stadler, Bunsenstrasse 3a, D-69214 Eppelheim; Volker Weindel, Turnerstrasse 126, D-69126 Heidelberg, all of Germany

[21] Appl. No.: 09/130,669

[22] Filed: Aug. 7, 1998

[30] Foreign Application Priority Data

Aug. 7, 1997 [DE] Germany ..... 197 34 199

[51] Int. Cl.[6] ..... B41J 5/00

[52] U.S. Cl. ..... 101/216; 101/415.1; 101/477; 100/53

[58] Field of Search ..... 101/212, 216, 101/415.1, 477; 100/53

[56] References Cited

U.S. PATENT DOCUMENTS

| | | | |
|---|---|---|---|
| 5,241,903 | 9/1993 | Lampic | 100/53 |
| 5,487,336 | 1/1996 | Simeth | 101/216 |
| 5,537,922 | 7/1996 | Becker | 101/216 |
| 5,613,438 | 3/1997 | Rehberg . | |
| 5,678,485 | 10/1997 | Guaraldi | 101/216 |
| 5,718,175 | 2/1998 | Guaraldi et al. | 101/477 |

FOREIGN PATENT DOCUMENTS

| | | |
|---|---|---|
| 44 02 158 C1 | 2/1995 | Germany . |
| 195 00 586 A1 | 7/1996 | Germany . |

*Primary Examiner*—Eugene Eickholt

[57] ABSTRACT

A positioning device for a printing press, having at least one guard adjustable within an adjustment range relative to an instantaneous pole axis in a first adjusting direction counter to gravity and in an opposed second adjusting direction, and having an energy storage for setting a variable support moment in opposition to a moment of weight resulting from the gravity and engaging with the guard, includes a control cam having a predetermined contour, a cam follower contacting the control cam for controlling the support moment by motion of the cam follower relative to the control cam, the contour of the control cam being such that the guard is in equilibrium at every location within the adjustment range under the influence of the support moment and a manual force of predetermined magnitude and direction which is associated with the respective location, the manual force, upon being adjusted in the first adjusting direction, counteracting the moment of weight in an initial section of the adjustment range.

14 Claims, 9 Drawing Sheets

POSITIONING DEVICE FOR A PRINTING PRESS

BACKGROUND OF THE INVENTION

Field of the Invention

The invention relates to a positioning device for a printing press having at least one guard adjustable within an adjustment range relative to an instantaneous pole axis in a first adjusting direction counter to gravity and in an opposed second adjusting direction, and having an energy storage for setting a variable support moment in opposition to a moment of weight resulting from the gravity and engaging with the guard. The invention also relates to a printing press having at least one guard which is adjustable within an adjustment range relative to an instantaneous pole axis in a first adjusting direction counter to gravity and in an opposed second adjusting direction.

Printing presses equipped with this type of adjustable guard have been made and sold, for example, by the firm Heidelberger Druckmaschinen A.G. under their model number CD102. They include, in particular, a guard covering the dryer segment, which is in the form of a kick plate. This plate can be pivoted between a horizontal position, wherein it covers a dryer section, and an upright position, the pivoting thereof being effected with respect to a stationary instantaneous pole axis. The guard has a spring assigned thereto, which sets a support moment in opposition to a moment resulting from the weight of the guard itself and engaging with the guard. This spring is loaded partly in tension and partly in torsion. The basic shape thereof is that of a U, with the legs of the U being many times shorter than the base of the U. The legs are joined in the form of a fixed fastening to the press frame, on both sides of the printing press, in such a position below the guard that the legs of the U are disposed in a substantially horizontal plane. In a middle region of the base of the U, the spring forms an elongated clip, which is disposed at an angle relative to the horizontal so that, in a substantially upright position of the guard established by a releasable lock, the clip is oriented upwardly without contacting the guard itself. During the pivoting of the guard from the upright position to the horizontal position, the clip comes into contact with the underside of the guard, and sets a support moment, which increases with increasing approach of the guard to the horizontal position thereof, into opposition with the moment resulting from the intrinsic weight of the guard itself.

In this manner, the required manual force for raising and lowering the guard is reduced.

SUMMARY OF THE INVENTION

It is accordingly an object of the invention to provide a positioning device for a printing press wherein risks of accident originating in a printing press, which can occur in conjunction with an adjustably supported guard, are reduced.

With the foregoing and other objects in view, there is provided, in accordance with one aspect of the invention, a positioning device for a printing press, having at least one guard adjustable within an adjustment range relative to an instantaneous pole axis in a first adjusting direction counter to gravity and in an opposed second adjusting direction, and having an energy storage for setting a variable support moment in opposition to a moment of weight resulting from the gravity and engaging with the guard, comprising a control cam having a predetermined contour, a cam follower contacting the control cam for controlling the support moment by motion of the cam follower relative to the control cam, the contour of the control cam being such that the guard is in equilibrium at every location within the adjustment range under the influence of the support moment and a manual force of predetermined magnitude and direction which is associated with the respective location, the manual force, upon being adjusted in the first adjusting direction, serving to counteract the moment of weight in an initial section of the adjustment range.

In accordance with another feature of the invention, the control cam is fixed in position, and the energy storage is formed by a spring assembly braced at one end thereof against the guard, and at the other end thereof against the cam follower.

In accordance with a further feature of the invention, the control cam is fixed in position, the energy storage is formed by a torsion bar spring extending parallel to the instantaneous pole axis, the torsion bar spring being rotatably supported with regard to the torsion axis thereof on the guard, respectively, in the region of a first end and an opposed second end thereof, the cam follower being connected in the region of the first end thereof to the torsion bar spring so as to be fixed against rotation relative thereto, and a hollow profile surrounding the torsion bar spring and being connected thereto in the region of the second end thereof so as to be fixed against rotation relative thereto, the hollow profile extending longitudinally between the ends of the torsion bar spring, and being firmly connected to the guard at least at one location between the ends of the torsion bar spring for introducing the support moment into the guard.

In accordance with an added feature of the invention, the positioning device includes a force-locking connector for securing the hollow profile to the guard.

In accordance with an additional feature of the invention, the positioning device includes a first component group comprising a platform forming the guard and having an upper side serving as a walkway surface, and an underside, bearing sleeves secured to the underside of the platform and rotatably supporting a respective end of the torsion bar spring, the hollow profile being connected to the torsion bar spring so as to be fixed against rotation relative thereto, the force-locking connector and the cam follower being connected to the torsion bar spring so as to be fixed against rotation relative to the torsion bar spring, two further component groups, respectively, including an axial bolt aligned with a pivot axis of the guard, and a bearing plate pivotable about the axial bolt, one group of the second component groups, respectively, being separably connected to the first component group.

In accordance with yet another feature of the invention, the control cam is disposed in a stationary position, the cam follower is pivotally connected to the guard and the energy storage is formed by a compensation mass carried by the cam follower.

In accordance with yet a further feature of the invention, the control cam is pivotable in a first pivoting direction and in an opposed second pivoting direction, the control cam being pivotable in one of the pivoting directions thereof when the guard is adjusted in one of the adjusting directions thereof.

In accordance with yet an added feature of the invention, the energy storage is formed by a spring assembly braced in stationary position at one end thereof and braced against the cam follower at the other end thereof.

In accordance with yet an additional feature of the invention, the energy storage is formed by a compensation mass, and a connection is provided between the compensation mass and the cam follower for generating, by force of gravity of the compensation mass, a contact-pressure force between the cam follower and the control cam.

In accordance with still another feature of the invention, the positioning device includes at least one additional energy storage formed as a support pivotally connected in stationary position at one end thereof, and pivotally connected to the guard at another end thereof, the support having a variable length, a variation in energy stored in the support being dependent upon a change in length of the support.

In accordance with still a further feature of the invention, the additional energy storage is a gas spring, such as a bellows or dashpot.

In accordance with still an added feature of the invention, the support moment is introducible into the guard at locations spaced apart from one another.

In accordance with still an additional feature of the invention, the control cam contour has a course with an adjusting range including four coherent successive sections wherein the guard, when adjusted in the first adjusting direction, along a first and a third section of said four sections under the influence of the support moment and a manual force exerted on the guard and oriented in the direction of adjustment of the guard, and along a second and fourth section of the four sections under the influence of the support moment and a manual force exerted on the guard and oriented counter to the direction of the adjustment, is in equilibrium.

In accordance a concomitant aspect of the invention, there is provided a printing press, having at least one guard adjustable within an adjustment range relative to an instantaneous pole axis in a first adjusting direction counter to gravity and in an opposed second adjusting direction, and having an energy storage for setting a variable support moment in opposition to a moment of weight resulting from the gravity and engaging with the guard, and a positioning device comprising a control cam having a predetermined contour, a cam follower contacting the control cam for controlling the support moment by motion of the cam follower relative to the control cam, the contour of the control cam being such that the guard is in equilibrium at every location within the adjustment range under the influence of the support moment and a manual force of predetermined magnitude and direction which is associated with the respective location, the manual force, upon being adjusted in the first adjusting direction, serving to counteract the moment of weight in an initial section of the adjustment range.

In a printing press equipped in accordance with the invention, relatively low values for the requisite manual force for pivoting a guard from the horizontal position thereof to the upright position thereof can be attained. In particular, beyond a given pivoting distance in the direction of the upright position, the guard may assume this position automatically. With a suitable design of the contour and a suitable choice of the maximum support moment that can be generated by the energy storage, the guard, in the upright position thereof, will advantageously not drop into the horizontal position thereof if it should unintentionally be pushed against. In a preferred embodiment, a stable equilibrium position of the guard can be provided, for example, in a position of the guard located within the adjustment range.

Other features which are considered as characteristic for the invention are set forth in the appended claims.

Although the invention is illustrated and described herein as embodied in a positioning device for a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 11 is a plot diagram showing the course of the moment of gravity or weight, a predetermined course of a moment generated by manual force, and the course of the support moment resulting, for example, from the embodiment of FIGS. 2 and 3 and correlated with the courses of the manual force moment and the moment of gravity; and FIG. 12 is a plot diagram showing a predetermined course of the manual force as it may be realizable, for example, with an embodiment according to FIGS. 9 and 10.

DESCRIPTION OF THE PREFERRED EMBODIMENTS

Figure 1:
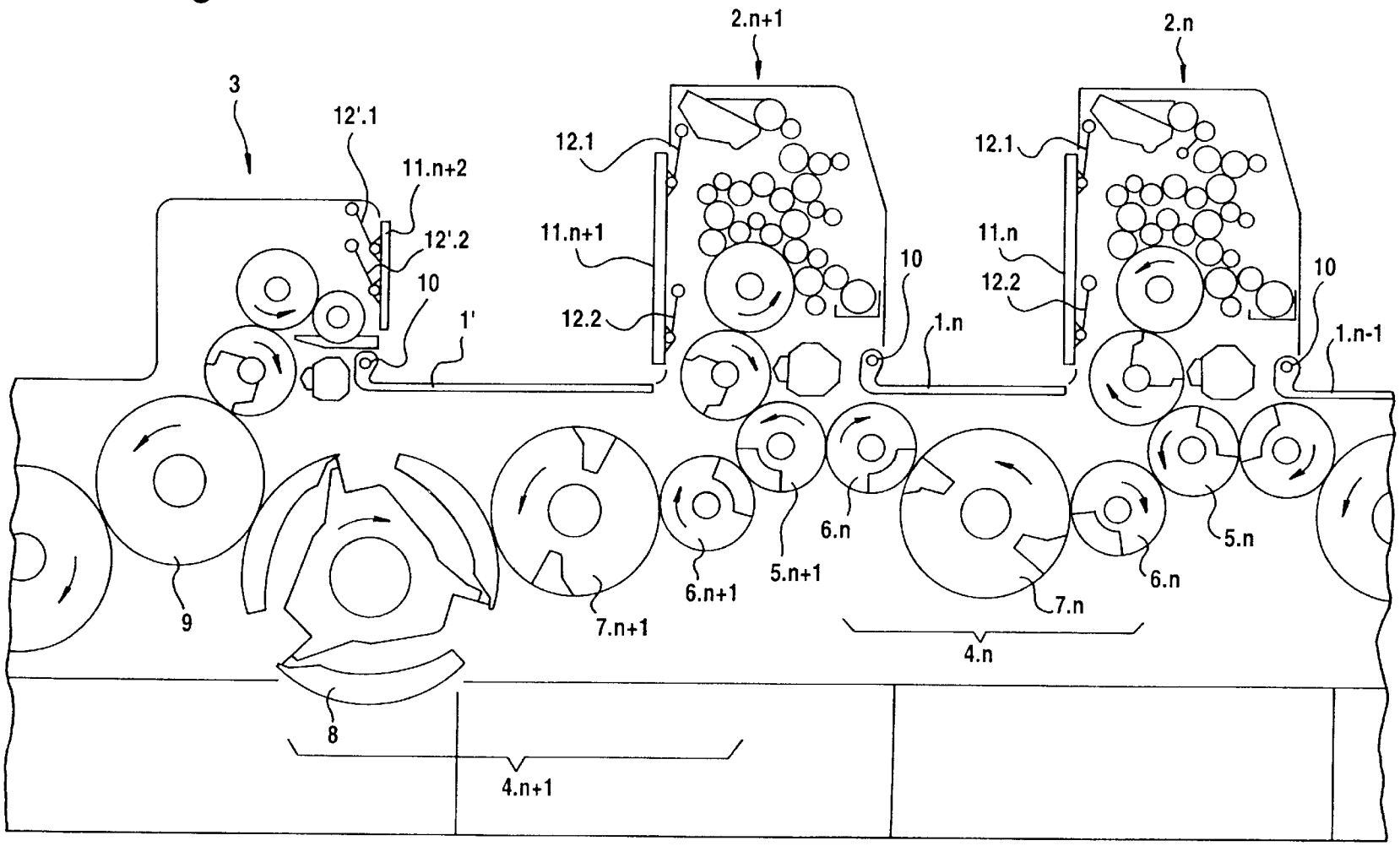
FIG. 1 is a diagrammatic side elevational view of a printing press showing examples of guards in the form of platforms pivotable about a pivot axis from a horizontal position to a substantially upright position between successive work stations, and liftable and lowerable guards which, in a lowered position thereof, shield cylinders of a work station.

Referring now to the drawings and, first, particularly to FIG. 1 thereof, there are shown therein, guards l.n−1, l.n and l' in a horizontal position thereof, respectively covering an opening located between side walls of a sheet-fed printing press, above sheet transfer sections 4.n and 4.n+1; in the embodiment shown in FIG. 1, the latter sections 4.n and 4.n+1 transport the sheets from a printing unit 2.n to a successive printing unit 2.n+1, and from a printing unit 2.n+1 to a successive finishing unit 3. The printing press shown herein, by way of example, is an offset rotary printing press having three, but optionally more, processing stations in the form of printing and finishing units. In the press concept, again shown by way of example herein, the sheet transfer section 4.n includes a single-revolution transfer drum 6.n that follows an impression cylinder 5.n and transfers a sheet printed in the printing unit 2.n to a half-revolution storage drum 7.n, which surrenders the sheet to a further single-revolution transfer drum 6.n, which finally transfers the sheet to an impression cylinder 5.n+1 of the next printing unit 2.n+1. The sheet transfer section 4.n+1 provided in this embodiment deviates from the preceding section 4.n in that the half-revolution storage drum 7.n+1 is followed by a one-third-revolution transfer drum 8, which transfers the sheet taken over from the storage drum 7.n+1 to an impression cylinder 9 of a finishing unit 3. Because of the one-third-revolution transfer drum 8, the sheet transfer section 4.n+1 has a greater resultant length in the longitudinal direction of the printing press than the sheet transfer section 4.n, so that, to cover the sheet transfer section 4.n+1, a larger guard 1' of correspondingly greater weight is needed than to cover the sheet transfer section 4.n. This fact, that the press concept specifically affects the size of guards which cover sheet transfer sections, leads, as will be explained hereinafter, to a refinement of the subject of the invention so that, for guards of relatively greater weight, a plurality of hoisting aids in the form of energy storage devices are provided.

The guards 1.n−1, 1.n and 1' are embodied as platforms which can be walked on. They are supported in the side walls of the printing press and, within an adjustment range of approximately 90° with respect to pivot axes 10, are manually pivotable out of the horizontal position thereof shown in FIG. 1 into an upright position thereof counter to gravity. To reduce the manual force required for this purpose, the respective guard 1.n−1, 1.n, 1' has at least one energy storage assigned thereto, which sets a variable support moment against a moment of gravity or weight resulting from gravity and acting upon the guard 1.n−1, 1.n, 1'.

The guards 11.n, 11.n+1 and 11.n+2 diagrammatically shown in FIG. 1, in the illustrated position thereof, cover an opening located between the aforementioned side walls of the printing units 2.n and 2.n+1 or of the finishing unit 3. In contrast with the guards 1.n−1, 1.n and 1', the guards 11.n, 11.n+1 and 11.n+2, in the covering position thereof, extend upwardly in the vertical direction of the processing stations of the printing press embodied by finishing and printing units and, in the exemplary embodiment of FIG. 1, are pivotally connected to a respective side wall of the printing press by parallel connecting rods 12.1, 12.2 and 12'.1, 12'.2, respectively, so that within an adjustment range they are adjustable relative to an instantaneous pole axis in a first adjusting direction counter to gravity and in a second adjusting direction opposed thereto. In this regard, the respective instantaneous pole axis is located in the infinite range whereas, in the case of the guards 1.n−1, 1.n and 1', it is disposed in the respective pivot axis 10.

The disposition of the guards 11.n and 11.n+1 shown on the side of the printing units 2.n and 2.n+1 directed downstream in terms of the processing direction of the printing press, and the disposition of the guard 11.n+2 on the upstream-directed side of the finishing unit 3, are merely respective examples.

The energy storages provided in order to reduce the manual force required for the adjustment will be described hereinafter in the course of the description of the different embodiments of the positioning device.

Figure 2:
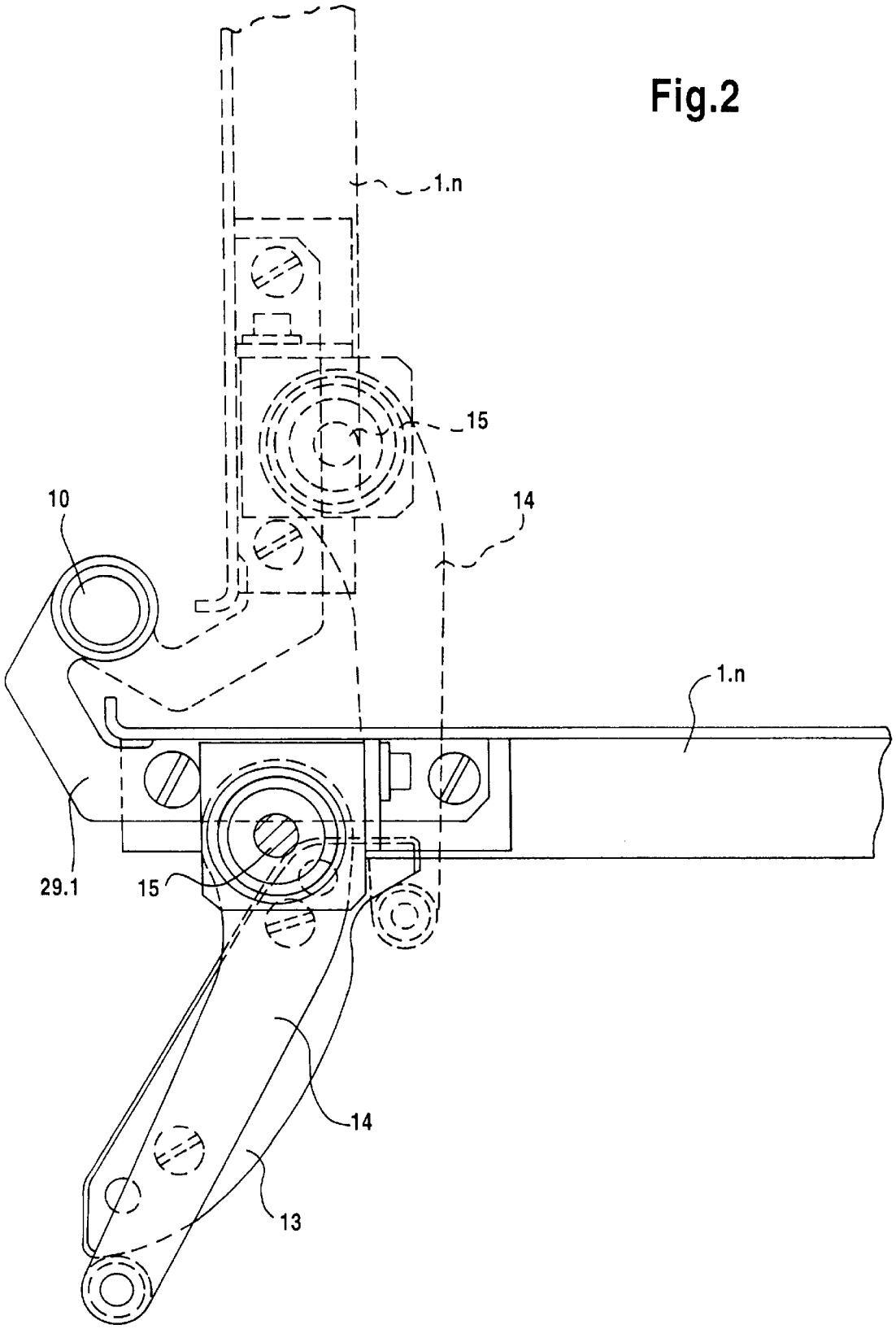
FIG. 2 is an enlarged fragmentary sectional view of a hereinafter described FIG. 3 taken along the line II—II and showing an exemplary embodiment of a positioning device with a stationary control cam in a guard formed as a platform pivotable with respect to a pivot axis out of a horizontal position thereof represented in solid lines and into a substantially upright position thereof represented in broken lines.

To explain a first embodiment of the positioning device, in FIG. 2, by way of example, the guard 1.n of FIG. 1, removed or isolated from the printing press, is shown in solid lines in the horizontal position thereof, and in broken lines in the upright position thereof. A control cam 13 provided with a predetermined contour is firmly connected to one of the non-illustrated side walls of the printing press. The contour of the control cam 13 is in contact with a cam follower 14, which controls the support moment by way of a relative motion between itself and the control cam 13. The relative motion between the cam follower 14 and the control cam 13 is a consequence of the adjustment of the guard 1.n.

The energy storage for generating the support moment, in the embodiment of FIG. 2, is a spring assembly formed by a torsion bar spring 15, which is braced at one end thereof against the guard 1.n, and at the other end thereof against the cam follower 14. The torsion bar spring 15 is preferably disposed parallel to the instantaneous pole axis, shown embodied in FIG. 2 by the pivot axis 10, so that in FIG. 2 only the cross section of the bar of the torsion bar spring 15 can be seen.

Figure 3:
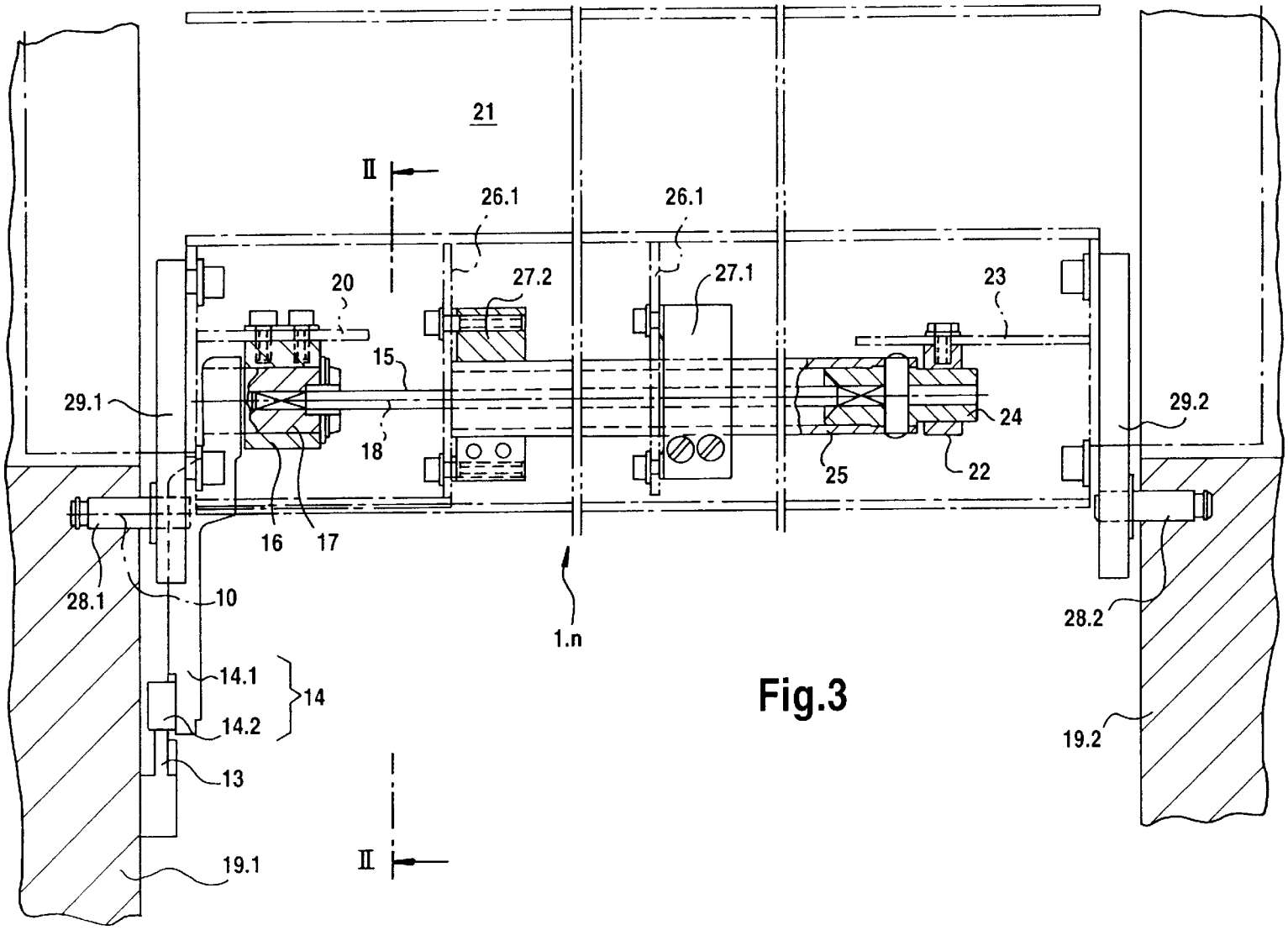
FIG. 3 is a reduced plan view of FIG. 2 showing the guard disposed in the horizontal position thereof, with the exemplary embodiment of the positioning device in the guard, and further showing partly in section a view taken along a torsion axis of a torsion bar spring serving as an energy storage wherein, in the interest of clarity, those parts which are actually not visible because they are covered by a kick plate of the platform are shown in solid lines, while the kick plate and ribs attached to the underside thereof are shown in broken lines.

In FIG. 3, there are shown, in particular, the firm connection of the control cam 13 to the aforementioned side wall 19.1 and the bracing, provided at one end against the guard 1.n and at the other end against the cam follower 14, of the torsion bar spring acting as an energy storage. The details of this bracing are contemplated in the embodiment as described hereinafter.

At a side of the guard 1.n facing towards the control cam 13, on the underside of that guard 1.n, a first bearing sleeve 16 is secured, which rotatably supports a first hollow shaft portion 17 with respect to an axis parallel to the pivot axis 10. The cam follower 14 is formed by a lever 14.1 and a roller 14.2, which contacts the contour of the control cam 13 and is rotatably supported on one end of the lever 14.1. The other end of the lever 14.1 is connected to the first hollow shaft portion 17 so as to be fixed against rotation relative thereto. This portion 17, in turn, form-lockingly receives a first end of the torsion bar spring 15 in a manner that it is secured against rotation, so that finally the torsion bar spring 15, in the region of the first end thereof, is supported rotatably on the guard 1.n with regard to the torsion axis 18 thereof and is connected to the cam follower 14 in a manner fixed against rotation relative thereto. In regard to the foregoing, it is noted that a form-locking connection is one which connects two elements together due to the shape of the elements themselves, as opposed to a force-locking connection, which locks the elements together by force external to the elements.

The bearing sleeve 16 provided for rotatably supporting the torsion bar spring 15 is screwed to a rib 20, which is secured to the underside of the platform 21 forming the guard 1.n, for example by welding.

On a side of the guard 1.n remote from the control cam 13, in a manner corresponding to that for the bearing sleeve 16, a second bearing sleeve 22 is screwed to the underside of the guard, specifically to another rib 23, which is secured to the underside of the platform 21, again for example by welding. This second bearing sleeve 22 is aligned with the bearing sleeve 16 and rotatably receives a hollow shaft portion 24, which, in turn, form-lockingly encloses a second end of the torsion bar spring 15 opposed to the first end thereof, in a manner secured against mutual rotation. Thus, the torsion bar spring 15, at both ends thereof with respect to the torsion axis 18 thereof, is supported rotatably on the guard 1.n.

Extending between the two bearing sleeves 16 and 22 is a hollow profile 25, which encloses the torsion bar spring 15. The hollow profile 25 is embodied in FIG. 3 as a tube having a circular-ringshaped cross section; it is slipped onto a part of the second hollow shaft portion 24 that protrudes past the bearing sleeve 22 and is connected to this portion in a manner fixed against rotation relative thereto, so that finally, in the region of the second end of the torsion bar spring 15, it is connected to the torsion bar spring 15 in a manner fixed against rotation relative thereto and extends longitudinally between the ends of the torsion bar spring 15.

A clamping block 27.1 is fastened to at least one further rib 26.1 secured to the underside of the platform 21, for example, by welding, the clamping block 27.1 being disposed between the ends of the torsion bar spring 15 and being embodied so that the hollow profile 25, shown here as a tube, can be fastened in place therewith. For this purpose, in the exemplary embodiment of FIG. 3, the clamping block 27.1 is formed with a slit bore matching the outer diameter of the hollow profile tube 25 and via which, a force-locking connection between the tube 25 and the clamping block 27.1 can be made by a screw connection provided at the slit. In this regard, a force-locking connection is one which connects two elements together by force external to the elements, as opposed to a form-locking connection which is provided by the shapes of the elements themselves.

With this force-locking connection, the support moment resulting from a given load condition of the energy storage, here in the form of the torsion bar spring 15, and the effective lever arm of the contact-pressure force between the control cam 13 and the roller 14.2 of the cam follower 14, which force is dependent upon the load condition, is introducible into the guard 1.1, the applicable load condition being the result of alternating deflections of the cam follower 14 with respect to the torsion axis 18 of the torsion bar spring 15 and optionally from a "basic loading" generated by prestressing of the torsion bar spring 15.

The aforementioned force-locking connection proves to be advantageous in the sense that it can be effected especially in a position of the guard 1.n wherein the aforementioned load condition is at a minimum. In this position, for example, a torque wrench can then be applied to the second hollow shaft portion 24 suitably embodied for the purpose, and a torsional moment corresponding to the requisite load condition in this position can thus be impressed upon the torsion bar spring 15. Thereafter, the force-locking connection can then be effected between the hollow profile 25 embodied as a tube, and the clamping block 27.1.

If the guard 1.n is embodied as relatively torsion-resistant and/or with a relatively low weight, it may suffice to provide a single clamping block 27.1. Otherwise, it has proven to be advantageous to make at least one further connection, again preferably a force-locking connection, between the hollow profile 25 and the guard 1.n, as is effected in the embodiment at hand by the additional clamping block 27.2. The placement of the two clamping blocks 27.1 and 27.2 and, optionally, yet another clamping block at corresponding points between the ends of the torsion bar spring 15 is effected so that the guard 1.n, at least in the horizontal position thereof wherein it is braced by non-illustrated stops, is not subject to any significant connection, even though the support moment introduced at distributed locations into the guard 1.n is in the vicinity of a maximum thereof in this position.

Based upon the pivot axis 10 which, in the exemplary embodiment of FIG. 3, is disposed above the level of the walkway surface of the horizontally positioned guard 1.n, and based upon the course of the manual force provided here, as will be explained hereinafter in this specification, the maximum support moment is not attained until after the guard 1.n is raised into a lower pivoting position thereof, wherein, however, a given torsion can be allowed, especially because, upon further pivoting into the upright position, due to the decrease in the weight moment and an attendant decrease in the support moment required for the course of the manual force, this torsion drops off again.

By combining the guard and parts of the positioning device into hereinafter described component groups, an especially advantageous assembly thereof in the printing press is possible. A first one of the component groups includes a platform 21 forming the guard 1.n and having an upper side forming a walkway surface and an underside; the bearing sleeves 16 and 22 secured to the underside of the platform 21, each of the bearing sleeves rotatably supporting one end of the torsion bar spring 15; the hollow profile 25 firmly joined to the torsion bar spring 15; the force-locking connection in the form of the clamping blocks 27.1 and 27.2; and the cam follower 14 joined firmly to the torsion bar spring. Two further component groups, respectively, include respective axial bolts 28.1 and 28.2 which are aligned with the pivot axis 10 and are each received in a respective side wall 19.1 and 19.2; and bearing plates 29.1 and 29.2 pivotable about the respective axial bolts 28.1 and 28.2. Between these two bearing plates 29.1 and 29.2, which are carried by the side walls 19.1 and 19.2, the platform 21 preassembled as explained hereinabove, can be inserted and detachably connected, in this case by a screw connection, to a respective one of the bearing plates 29.1 and 29.2, at corresponding joining faces and are embodied, on the one hand, on the bearing plates 29.1 and 29.2, and on the other hand, on the platform 21. The insertion of the platform 21 can be effected, for example, in the upright position of the platform and advantageously before the force-locking connection is made between the hollow profile 25 and the guard 1.n, so that upon insertion of the guard 1.n into the printing press, there are no hindrances from the effects of force on the part of the energy storage provided here in the form of the torsion bar spring 15.

Figure 4:
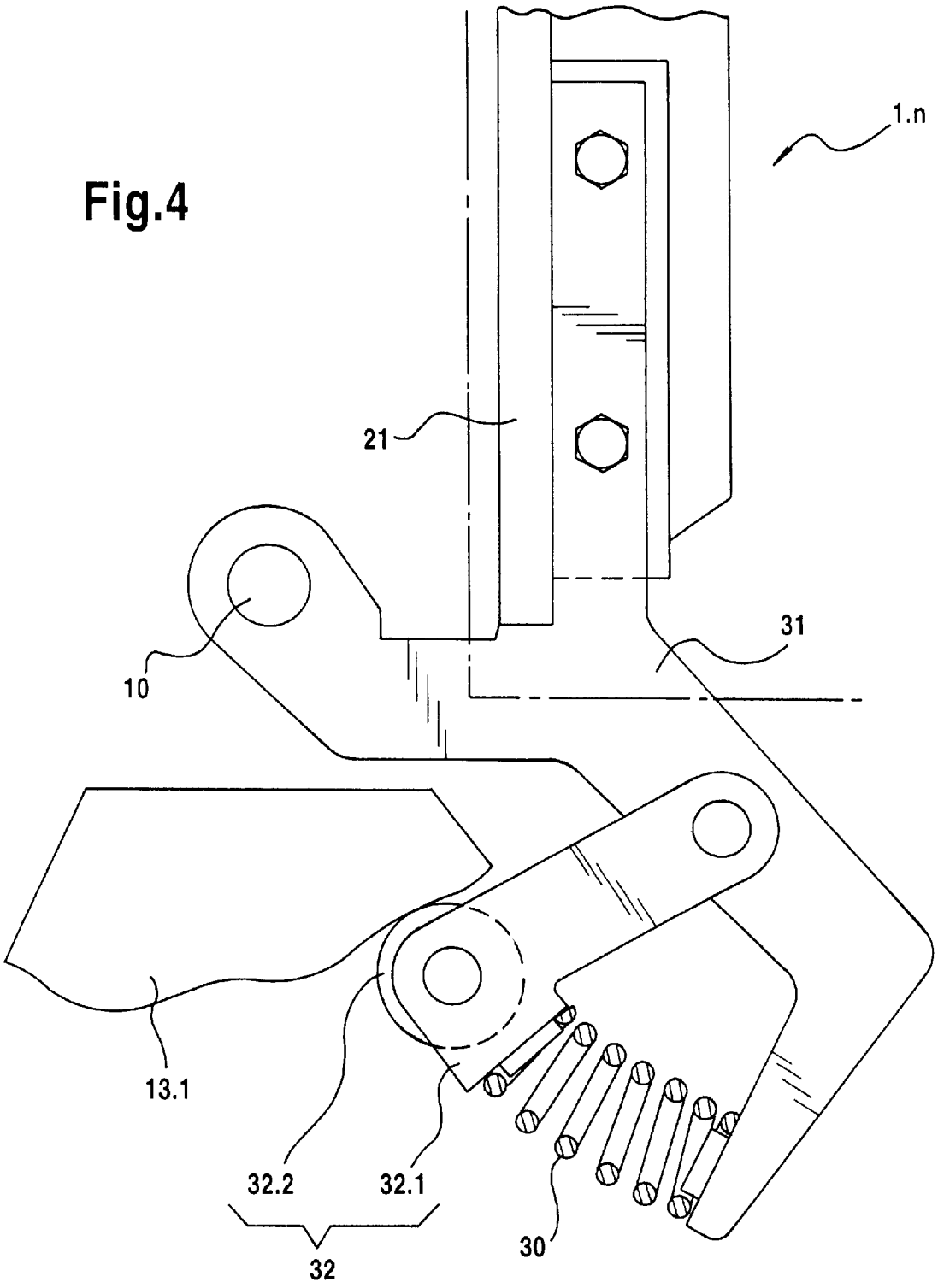
FIG. 4 is a diagrammatic view like that of FIG. 2 of a different embodiment of the positioning device having a stationary control cam and an energy storage in the form of a spring braced at one end against a cam follower and at the other end against the guard.

In a further embodiment of the positioning device diagrammatically shown in FIG. 4, instead of a torsion bar spring as in FIGS. 2 and 3, a compressed helical spring 30 is used as the energy storage. The helical spring 30 is, in turn, braced at one end against the guard 1.n, shown here in the upright position, and at the other end against a cam follower 32, which contacts a locally fixed control cam 13.1. The platform 21 is firmly joined to a lever 31 which, in a manner corresponding to the bearing plates 29.1 and 29.2 of FIG. 3, is pivotally supported relative to the pivot axis 10 and forms a first bracing member for the helical spring 30. The cam follower 32 formed, in turn, by a lever 32.1 and a roller 32.2 rotatably supported thereon and capable of rolling along the control cam 13.1 has a pivotable connection of the lever 32.1 thereof with the lever 31 secured to the guard 1.n, and with the end thereof that carries the roller 32.2 forms a second bracing member for the helical spring 30. To prevent torsion of the platform 21 in the horizontal position thereof, the aforementioned arrangement of the control cam 13.1, the cam follower 13.2, the helical spring 30 and the lever 31 is preferably contemplated on both sides of the printing press.

Figure 5:
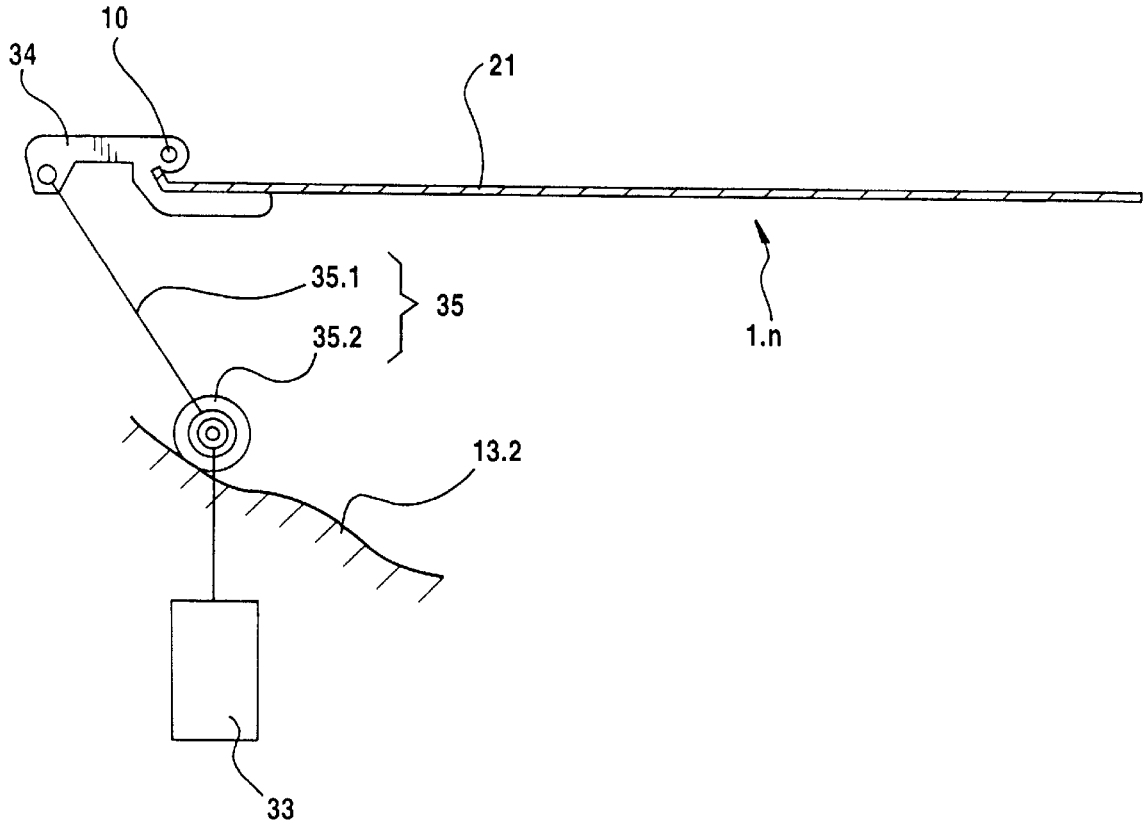
FIG. 5 is a diagrammatic and schematic view of another embodiment of the positioning device having an energy storage in the form of a compensation mass, and a stationary control cam as in the preceding figures.

Yet another embodiment of the positioning device shown in FIG. 5 has a compensation mass 33 as the energy storage thereof. The control cam 13.2 is again fixed in position. The platform 21 is firmly joined to a lever 34. A cam follower 35 is pivotally connected to the lever 34. The cam follower 35 has a connecting rod 35.1, which is pivotally connected to the lever 34 and thus to the guard 1.n, and a roller 35.2 which is rotatably supported on the connecting rod 35.1, rolls on the control cam 13.2 upon an adjustment of the guard 1,n. The compensation mass 33 is carried by the cam follower 35 and, to that end, is suspended from the roller axis or shaft of the roller 35.2. Instead of the pivotable connection by the connecting rod 35, a cable may also be provided for this purpose.

While the different embodiments of the positioning device described thus far each have a stationary control cam, in a further embodiment, a control cam is provided which is pivotable in a first pivoting direction and in an opposed second pivoting direction; upon an adjustment of the guard, in one of the adjusting directions thereof, the guard pivots the control cam in one of the pivoting directions thereof. This embodiment is equally suitable for adjusting a guard in the form of the platform 21, but will be explained hereinafter, taking as an example the guard 11.n of FIG. 1, which in a lowered position thereof covers the cylinders of a processing station.

Figure 6:
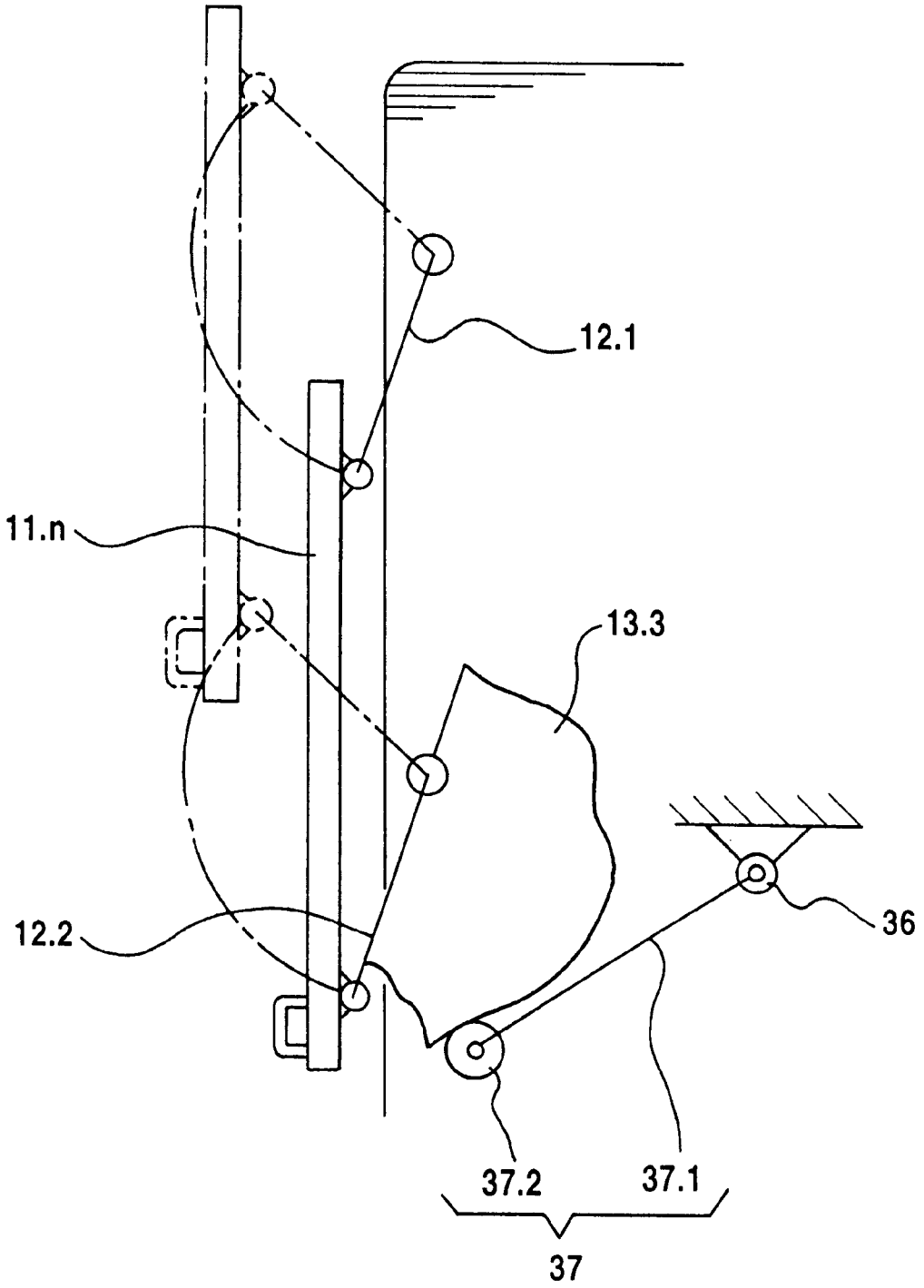
FIG. 6 is a diagrammatic and schematic view of a further embodiment of the positioning device of an exemplary guard which, in the lowered position thereof, shields cylinders of a work station of the printing press, the positioning device once again having an energy storage formed by a torsion bar spring, and a pivotally disposed control cam.
Figure 7:
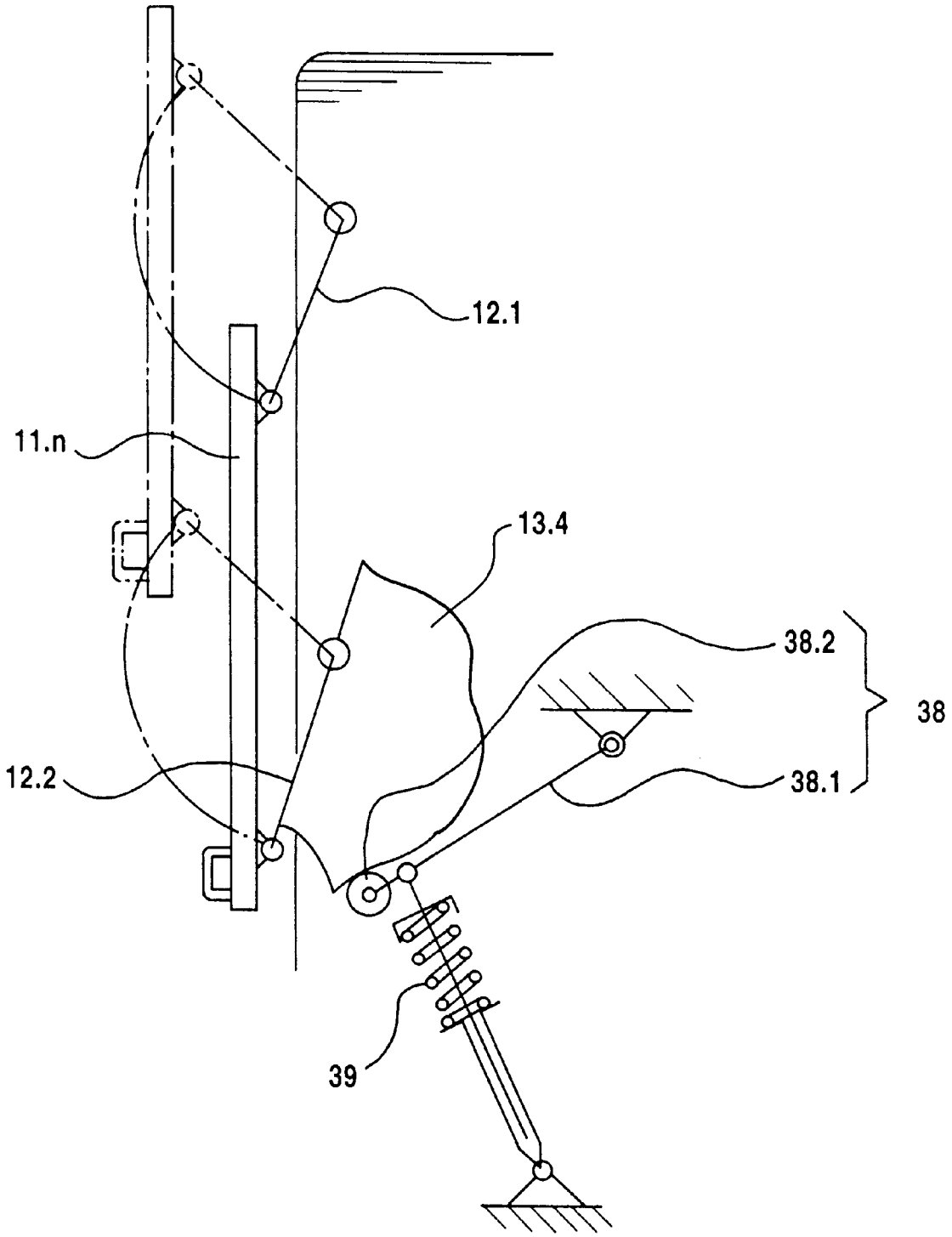
FIG. 7 is a view like that FIG. 6 of the exemplary guard with yet another embodiment of the positioning device having an energy storage formed by a helical spring, and an again pivotally disposed control cam.
Figure 8:
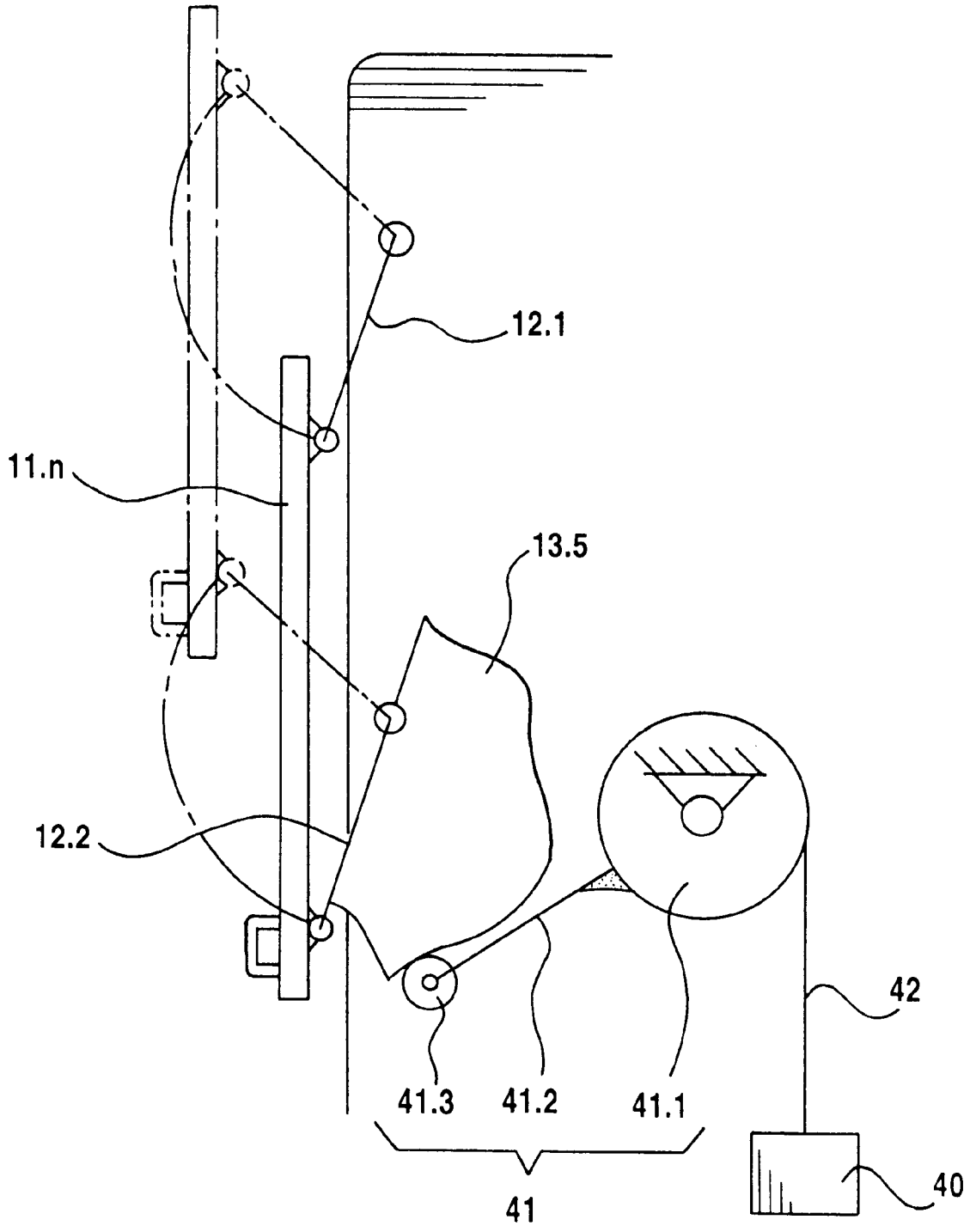
FIG. 8 is a view like those of FIGS. 6 and 7 of the exemplary guard with yet a further embodiment of the positioning device differing from those of FIGS. 6 and 7 in that the energy storage is represented here by a compensation mass.

In the various different embodiments of the invention shown in FIGS. 6 to 8, a respective connecting rod 12.2 is firmly joined to the control cams 13.3, 13.4 and 13.5, respectively. Thus, the guard 11.n, upon an adjustment thereof in one of the adjusting directions thereof, pivots the respective control cam 13.3, 13.4, 13.5 in one of the pivoting directions thereof.

The embodiment shown in FIG. 6 has, as the energy storage thereof, a torsion bar spring 36, illustrated in cross section. The torsion bar spring 36 is fastened in stationary position by one of the ends thereof, and at the other end thereof is firmly joined to the lever 37.1 which, together with a roller 37.2 rotatably supported on a free end of the lever 37.1, forms a cam follower 37, the roller 37.2 of which rolling along the control cam 13.3 upon an adjustment of the guard 11.n.

Instead of the torsion bar spring 36, a coiled spiral spring may also be used, which is again fastened in stationary position by one end thereof, and at the other end thereof is firmly joined to the lever 37.1, so that it is braced at one end in stationary position and at the other end against the cam follower 37.

The embodiment shown in FIG. 7 has, as the energy storage thereof, a compressed helical spring 39 which is fixedly braced at one end thereof, and at the other end thereof is braced against a cam follower 38. In this regard, the cam follower 38 is formed by a connecting rod 38.1 having a fixed pivotal connection; this connecting rod 38.1 rotatably supports a roller 38.2 that contacts the control cam 13.4.

In the variant shown in FIG. 8, instead of a spring assembly, an energy storage in the form of a compensation mass 40 is provided. Between the latter and a cam follower 41, a connection is provided which, by the force of gravity of the compensation mass 40, generates a contact-pressure force between the cam follower 41 and the control cam 13.5. In this regard, a disk 41.1 having a stationary support is provided, a cable 42 carrying the compensation mass 40 being rollable up and down along the circumference of the disk 41.1. The disk 41.1 is connected to an end of an arm 41.2 so as to be secured against rotation relative thereto, the arm 41.2, at the free end thereof, rotatably supporting a roller 41.3 that engages the control cam 13.5.

Figure 9:
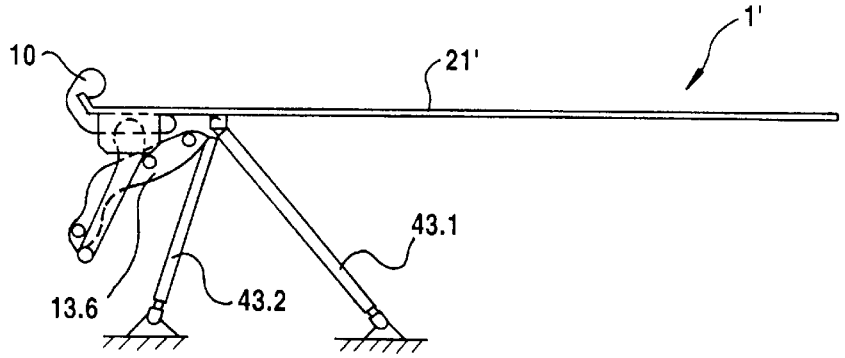
FIG. 9 is a diagrammatic side elevational view of an exemplary guard formed as a platform shown oriented horizontally, the guard being pivotable relative to a pivot axis out of the horizontal position and into an upright position, with an embodiment of the positioning device supplemented by an additional energy storage.

In FIG. 9, taking as an example the guard 1' of FIG. 1, a further embodiment of the positioning device is shown. It is distinguished from that of FIGS. 2 and 3 in particular in that at least one additional energy storage is provided, specifically in the form of a variable-length support 43.1 or 43.2, with a change in energy stored in the support 43.1 or 43.2 that is dependent upon the change in length thereof. Such a support may, for example, be embodied in the form of the telescoping assembly formed by the helical spring 39 formed in FIG. 7. However, in the embodiment of FIG. 9, a gas spring is preferably provided instead. This spring is pivotally connected in stationary position at one end thereof and, at the other end thereof, is pivotally or articulatedly connected to the guard 1'.

The guard 1' which, because of the greater dimensions of the platform 21' thereof, has a greater weight than the guard 1.n, is thus equipped with a plurality of hoisting aids. A first such aid is realized by a positioning device of the type described in conjunction with FIGS. 2 and 3, but which, in the embodiment of FIG. 9, has a control cam 13.6 with a contour that differs from that of the control cam 13. This difference is due to the fact that the at least one additional energy storage, in the form of a support 43.1 and 43.2, respectively, formed by a gas spring and, because of the intended disposition thereof, already generates, depending upon the position of the guard 1.1, part of whatever support moment is in the final analysis required for the predetermined course of the manual force.

Figure 10:
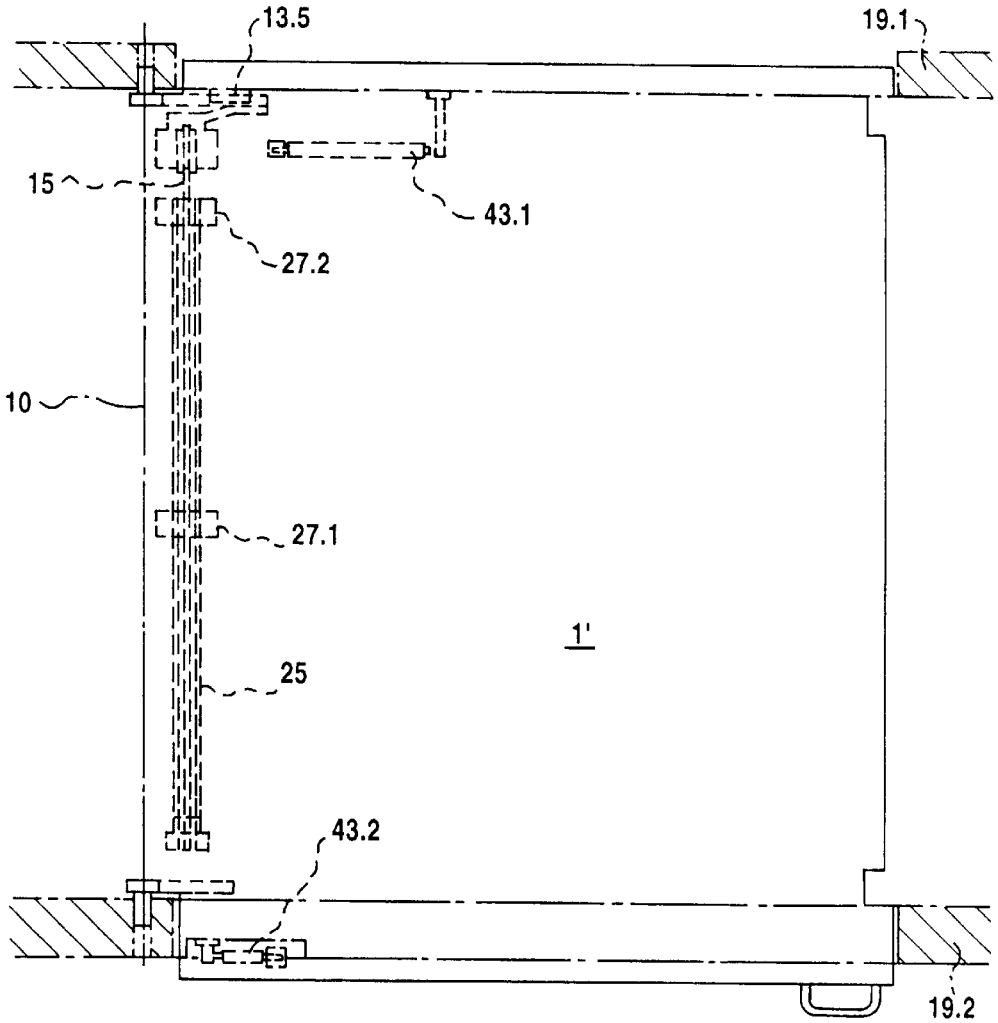
FIG. 10 is a simplified plan view of FIG. 9, showing the disposition of the guard relative to side walls of the printing press.

As in the case of the positioning device of FIGS. 2 and 3, the introduction of parts of the support moment takes place at spaced-apart points along the hollow profile 25 in the guard 1.n by the clamping blocks 27.1 and 27.2, while parts of the support moment furnished by the additional energy storage, in the present case, two storages, as in FIGS. 9 and 10, in the form of supports 43.1 and 43.2, are again introduced at spaced-apart locations in the guard 1', as can be seen in FIG. 10. Of the supports 43.1 and 43.2, one thereof is disposed in the region of each of the side walls 19.1 and 19.2, at which, in the embodiment of FIG. 10, the aforementioned stationary pivotable bracing of the supports 43.1 and 43.2 is also provided. By introducing the support moment in this manner, as explained hereinbefore, the torsion of the guard 1' in the horizontal position thereof is counteracted.

With the embodiments described hereinbefore, the equilibrium mentioned at the outset for a preferred course of a moment generated by manual force can be established, as shown particularly in the plot diagram or graph of FIG. 11. This graph is representative and specific for an embodiment according to FIGS. 2 and 3, that is, for the case of the guard 1.n that is pivotable relative to the pivot axis 10 out of a horizontal position and into an upright position within the adjusting range V of 90°. The predetermined course of the moment generated by manual force shown in this graph, represented by the line H over the adjusting range V shown in degrees of angle, in conjunction with the course of the weight moment represented by the line G, determines the course of the support moment S which, in turn, determines the contour of the control cam 13 that thus results from a calculation based upon an equilibrium observation wherein, along with the weight moment, the parameters of the positioning device which are definitive for the equilibrium of moment in a given position of the guard 1.n are taken into account. Because the course of the moment H generated by manual force and the manual force are quantitatively the same, the line H in FIG. 11 also stands for the course of the manual force itself. Hereinafter, the manual force will therefore also be represented by the symbol H.

The predetermined course of the moment generated by manual force H exhibits a manual force H in an initial portion V.1 of the adjusting range V that counteracts the weight moment G. At the end of the section V.1, or in other words after the guard 1.n has been raised a given pivoting angle out of the horizontal position thereof, the manual force H has the value of zero, and in an ensuing section V.2 of the adjusting range V it changes its sign or in other words its direction, grows to a given magnitude, and then at the end of the section V.2 drops back to the value of zero again. Thus, if the guard 1.n were released at the end of the section V.1, it would either drop back into the horizontal position thereof or, under the influence of the support moment S, it would be raised automatically at least until the end of the section V.2. Thus, at the end of the section V.1, an unstable equilibrium prevails.

The section V.2 is followed by a further section V.3 of the adjusting range V. In this section V.3, once again a manual force H that counteracts the weight moment is provided and reaches a given magnitude within the section V.3 and at the end thereof drops back to the value of zero. At the transition from the second section V.2 to the third section V.3, a stable equilibrium prevails, because further erection of the guard 1.n requires a manual force H acting in the first adjusting direction thereof, while an adjustment in the opposed, second adjusting direction thereof requires a moment generated by manual force H that would have to act in the same direction as the weight moment G. Thus, releasing the guard 1.n in one of the sections V.2 and V.3 would cause the guard 1.n to settle into position at the transition between these two sections V.2 and V.3. In the present example, this stable equilibrium position is assumed to be approximately halfway along the adjusting range V. The predetermined course of the moment generated by the manual force H thus prevents the guard 1.n from falling back into the horizontal position thereof from a largely upright position.

The third section V.3 is followed by a fourth section V.4 of the adjusting range V. In this section V.4, the manual force H provided to establish the equilibrium is oriented in the same direction as in the second section V.2; it rises to a given value and then, at the end of this section V.4 attained after an adjustment of the guard 1.n from 0 (corresponding to the horizontal position thereof) to several degrees prior to 90°, drops back to the value of zero.

Because, in this fourth position V.4, closing the guard 1.n or in other words adjusting it with reinforcement by gravity in the second adjusting direction requires a manual force H oriented in precisely this direction, assurance is provided that the guard 1.n, if pushed unintentionally in this second adjusting direction, will not necessarily execute an adjusting motion in this second adjusting direction. It would do so only if the energy of this push were to exceed the amount of the energy supplied to the guard 1.n by the energy storage in the fourth section V.4. Yet even in this case, because of the otherwise provided course of the moment generated by manual force H, as explained hereinbefore, the guard 1.n would settle into position at the transition between the second section V.2 and the third section V.3.

Overall, this markedly reduces the risks that are associated with a guard of a printing press that can be adjusted counter to gravity.

If the position of the guard 1.n reached at the end of the fourth section V.4 is taken as the upright terminal position, then further erection can be prevented, for example, by a stop. In the embodiment at hand, however, instead of this, a fifth section V.5 of the adjusting range V is provided, following the fourth section V.4; in this fifth section, for an adjustment of the guard 1.n that goes beyond the end of the fourth section V.4, a manual force is predetermined that is directed in the first adjusting direction and has a relatively steep rise. Thus, however, a stable equilibrium position again prevails at the transition from the fourth section V.4 to the fifth section V.5 of the adjusting range V, so that a stop that would be intended to prevent erection beyond the end of the fourth section V.4 can be omitted.

For an embodiment in accordance with FIGS. 9 and 10, wherein additional energy storages are provided, each of which is preferably formed by a gas spring, such as a bellows or dashpot, it is possible in principle again to provide the course shown in FIG. 11 for a moment generated by manual force. In the case at hand, however, once again a course of the manual force as plotted in the graph of FIG. 12 over the adjusting range V', again given in degrees of angle, is preferably provided. This course, analogously to the manner described in conjunction with FIG. 11, determines the contour of the control cam 13.6 that can be seen in FIG. 9.

Once again, in an initial section V.1' of the adjusting range V', the course of the manual force represented by the line H' in FIG. 12 has a manual force H' which counteracts the weight moment. At the end of this initial section V.1' or, in other words, after the guard 1' has been raised out of the horizontal position thereof a given pivoting angle, the manual force H' again has the value of zero, so that in this section V.1' the same conditions prevail as in the case of the embodiment of FIG. 11. Unlike the latter, however, the initial section V.1' is followed by only one further section V.2', which extends through to the end of the adjusting range V'. In this further section V.2', the amount of the predetermined manual force rises to a given value and then, towards the end of the adjusting range V', drops gradually to a residual amount. The direction of the predetermined manual force within the further section V.2' is again opposed to that in the initial section, so that once again, at the end of the initial section, an unstable equilibrium prevails, and upon attainment of the further section V.2, a release of the guard 1' causes the guard to move automatically to the upright position thereof.

In accordance with the course of the manual force H' in FIG. 12, in the upright position reached at the end of the adjusting range V', a residual amount of the manual force H', directed in the second adjusting direction, is provided in order to establish the equilibrium. To cause the guard 1' to remain automatically in this position, provision is therefore made, in the case at hand, that at least one of the supports 43.1 and 43.2, each formed by its own gas spring, can be lengthened precisely far enough for dispensing energy stored therein, that thereby a desired upright position of the guard 1' is attainable.

The preferred use of an additional energy storage not only offers the possibility explained above of a locally distributed introduction of the support moment into the guard, as a provision for preventing unacceptable torsion of the guard, but also the further advantage that the energy level of the energy storage, the load condition of which is controllable by the control cam via the cam follower, can be set to a lower level, compared with an embodiment without additional energy storage. In the case wherein the energy storage is embodied by a spring assembly, a moderate spring rate can thus be provided for the purpose, so that oscillating events that ensue in spring assemblies are kept within limits.

If, furthermore, additional energy storages are formed by gas springs, as is preferably contemplated, then they moreover have a damping effect upon the courses of motion of the guard. However, it will be appreciated that this leads to a further increase in safety to a human operator working around the guard.

In addition to the increased personal protection, the positioning device offers a number of other advantages. These also include protecting vulnerable components of the printing press, such as UV lamps of a dryer segment located below a guard embodied as a pivotable platform. Given a suitable choice of the energy content of the energy storage and optionally of one or more additional energy storages and of the contour of the control cam, it is possible that particularly in the initial section V.1, V.1' of the adjusting range V, V', only a relatively slight manual force is needed, and that the initial section extends over only a few degrees of angle. A possible mistaken release of the guard within this initial section then has as a consequence merely that the guard drops back at low speed into the horizontal position thereof, which is defined by a stop, so that when it strikes the stop, there is no significant impact, and thus damage to vulnerable components of the printing press is avoided.

By a suitable choice of parameters of the positioning device, the maximum requisite manual force can also be kept low, for example, in a course thereof provided in accordance with FIG. 11. This accordingly enables extremely user-friendly manipulation of a guard which is embodied, in particular, as a pivotable platform, both when the guard is being erected and when it is being pivoted back into the horizontal position thereof.

The aforementioned advantages are moreover attainable in the case of a relatively large guard, as well, so that even to cover a relatively large opening it is possible to use only a single guard. This has the further advantage of good accessibility to the printing press components which are exposed when the guard is opened, so that setup work and maintenance can be performed thereon ergonomically.

The embodiment subdivided into component groups that can be preassembled has the further advantage especially of being easily retrofitted, in the event that an additional weight is attached to the guard, for example, in the form of an air blower chest, thus increasing the weight moment. In the retrofitting, the torsion bar spring would merely have to be re-tensioned or replaced with a stronger torsion bar spring. this can be done especially easily in the aforementioned embodiment in the form of the preassembled component groups.

We claim:

1. A positioning device for a printing press having at least one guard adjustable within an adjustment range relative to an instantaneous pole axis in a first adjusting direction counter to gravity and in an opposed second adjusting direction, and having an energy storage for setting a variable support moment in opposition to a moment of weight resulting from the gravity and engaging with the guard, comprising a control cam having a predetermined contour, a cam follower contacting the control cam for controlling the support moment by motion of the cam follower relative to the control cam, said contour of said control cam being such that the guard is in equilibrium at every location within the adjustment range under the influence of the support moment and a manual force of predetermined magnitude and direction which is associated with the respective location, the manual force, upon being adjusted in the first adjusting direction, serving to counteract the moment of weight in an initial section of the adjustment range.

2. The positioning device according to claim 1, wherein said control cam is fixed in position, and the energy storage is formed by a spring assembly braced at one end thereof against the guard, and at the other end thereof against said cam follower.

3. The positioning device according to claim 1, wherein said control cam is fixed in position, the energy storage is formed by a torsion bar spring extending parallel to the instantaneous pole axis, said torsion bar spring being rotatably supported with regard to the torsion axis thereof on the guard, respectively, in the region of a first end and an opposed second end thereof, said cam follower being connected in the region of the first end thereof to said torsion bar spring so as to be fixed against rotation relative thereto, and a hollow profile surrounding said torsion bar spring and being connected thereto in the region of the second end thereof so as to be fixed against rotation relative thereto, said hollow profile extending longitudinally between the ends of the torsion bar spring, and being firmly connected to the guard at least at one location between the ends of the torsion bar spring for introducing the support moment into the guard.

4. The positioning device according to claim 3, including a force-locking connector for securing the hollow profile to the guard.

5. The positioning device according to claim 4, including a first component group comprising a platform forming the guard and having an upper side serving as a walkway surface, and an underside, bearing sleeves secured to said underside of said platform and rotatably supporting a respective end of said torsion bar spring, said hollow profile being connected to said torsion bar spring so as to be fixed against rotation relative thereto, said force-locking connector and said cam follower being connected to said torsion bar spring so as to be fixed against rotation relative to said torsion bar spring, two further component groups, respectively, including an axial bolt aligned with a pivot axis of the guard, and a bearing plate pivotable about said axial bolt, one group of said second component groups, respectively, being separably connected to said first component group.

6. The positioning device according to claim 1, wherein said control cam is disposed in stationary position, said cam follower is pivotally connected to the guard and the energy storage is formed by a compensation mass carried by said cam follower.

7. The positioning device according to claim 1, wherein said control cam is pivotable in a first pivoting direction and in an opposed second pivoting direction, said control cam being pivotable in one of the pivoting directions thereof when the guard is adjusted in one of the adjusting directions thereof.

8. The positioning device according to claim 7, wherein the energy storage is formed by a spring assembly braced in stationary position at one end thereof and braced against said cam follower at the other end thereof.

9. The positioning device according to claim 7, wherein the energy storage is formed by a compensation mass, and including a connection between said compensation mass and said cam follower for generating, by force of gravity of said compensation mass, a contact-pressure force between said cam follower and said control cam.

10. The positioning device according to claim 1, including at least one additional energy storage formed as a support pivotally connected in stationary position at one end thereof, and pivotally connected to the guard at another end thereof, said support having a variable length, a variation in energy stored in said support being dependent upon a change in length of said support.

11. The positioning device according to claim 10, wherein said additional energy storage is a gas spring.

12. The positioning device according to claim 1, wherein the support moment is introducible into the guard at locations spaced apart from one another.

13. The positioning device according to claim 1, wherein said control cam contour has a course with an adjusting range including four coherent successive sections wherein the guard, when adjusted in the first adjusting direction, along a first and a third section of said four sections under the influence of the support moment and a manual force exerted on the guard and oriented in the direction of adjustment of the guard, and along a second and fourth section of said four sections under the influence of the support moment and a manual force exerted on the guard and oriented counter to the direction of the adjustment, is in equilibrium.

14. A printing press, having at least one guard adjustable within an adjustment range relative to an instantaneous pole axis in a first adjusting direction counter to gravity and in an opposed second adjusting direction, and having an energy storage for setting a variable support moment in opposition to a moment of weight resulting from the gravity and engaging with said guard, and a positioning device comprising a control cam having a predetermined contour, a cam follower contacting said control cam for controlling the support moment by motion of said cam follower relative to said control cam, said contour of said control cam being such that the guard is in equilibrium at every location within the adjustment range under the influence of the support moment and a manual force of predetermined magnitude and direction which is associated with the respective location, the manual force, upon being adjusted in said first adjusting direction, serving to counteract the moment of weight in an initial section of said adjustment range.

* * * * *